US006044930A

United States Patent [19]

Hayman

[11] Patent Number: 6,044,930

[45] Date of Patent: Apr. 4, 2000

[54] STABILIZING BRACKET FOR A LADDER OR THE LIKE

[76] Inventor: Rocky Hayman, 39455 John Lanier Rd., Walker, La. 70785

[21] Appl. No.: 09/173,275

[22] Filed: Oct. 15, 1998

[51] Int. Cl.[7] ..... E06C 1/36

[52] U.S. Cl. ..... 182/206; 182/107

[58] Field of Search ..... 182/121, 150, 182/206, 107, 214; 248/210, 211

[56] References Cited

U.S. PATENT DOCUMENTS

| | | | |
|---|---|---|---|
| 494,868 | 4/1893 | Kelly . | |
| 987,399 | 3/1911 | Rashkovskv . | |
| 1,341,198 | 5/1920 | Ruple . | |
| 1,879,244 | 9/1932 | Hoffman . | |
| 2,142,651 | 1/1939 | Michelson . | |
| 2,554,675 | 5/1951 | Magnetti . | |
| 4,231,448 | 11/1980 | Jensen | 182/206 X |
| 5,054,581 | 10/1991 | Henson | 182/206 |
| 5,078,532 | 1/1992 | Williams . | |

*Primary Examiner*—Daniel P. Stodola
*Assistant Examiner*—Hugh B. Thompson
*Attorney, Agent, or Firm*—Joseph T. Regard, Ltd.

[57] ABSTRACT

A stabilizing scaffold bracket for a ladder or the like. The preferred embodiment of the present invention configured to affix a ladder to a scaffold in a stable, yet removable fashion, the apparatus of the invention including first and second aligned plates spaced by a spacer bar, the plates having first and second ends, the first end of the plates having formed therein an upper hook member to engage a horizontal bar of the scaffold, the second end of the plates having formed therein a lower hook member configured to engage the horizontal rung of a ladder, the second end further including an upper engagement member to engage the lateral supports of the ladder. Further provided are first and second pivotal cams to removably, yet firmly, secure the unit to the scaffold, once installed.

8 Claims, 3 Drawing Sheets

STABILIZING BRACKET FOR A LADDER OR THE LIKE

TECHNICAL FIELD OF THE INVENTION

The present invention relates to brackets for stabilizing generally vertically situated supports, and in particular to a stabilizing scaffold bracket for a ladder or the like. The preferred embodiment of the present invention contemplates a stabilizer bracket for affixing a ladder to a scaffold in a stable, yet removable fashion, the invention contemplating an apparatus including first and second aligned plates spaced by a spacer bar, the plates having first and second ends, the first end of the plates having formed therein an upper hook member to engage a horizontal bar of the scaffold, the second end of the plates having formed therein a lower hook member configured to engage the horizontal rung of a ladder, the second end further including an upper engagement member to engage the lateral supports of the ladder. The present invention also contemplates first and second pivotal cams to removably, yet firmly, secure the unit to the scaffold, once installed.

BACKGROUND OF THE INVENTION

Scaffolds of one design or another have been utilized for hundreds of years to provide a temporary support for the construction or maintenance of an adjacent area. Although scaffold construction has evolved over the years, and a consequence has been greatly improved in ease of construction, stability, and safety, there still does not exist an easily installed, yet safe and effective ladder bracket for removably securing a ladder to the scaffold.

Ropes, clamps, threaded fasteners, or welds have been utilized in the past to secure a ladder to the scaffold, all with some degrees of success, but none have provided the ease of use, stability, and safety of the device and system of the present invention.

Patents which may be of some pertinence to the present system include:

| Patent Number | Inventor | Date of Issue |
|---|---|---|
| 494868 | Kelly | 04/04/1893 |
| 987399 | Rashkovsky | 03/21/1911 |
| 1341198 | Ruple | 05/25/1920 |
| 1879244 | Hoffman | 09/27/1932 |
| 2142651 | Michelson | 01/03/1939 |
| 2554675 | Magnetti | 05/29/1951 |
| 5078532 | Williams | 01/07/1992 |

U.S. Pat. No. 1,341,198 to Ruple contemplates a support bracket "adapted to suspend bird cages, hanging flower baskets, and other objects at a distance from a wall or the like".

U.S. Pat. No. 2,142,651 issued 1939 teaches a scaffold including a ladder stabilized by first and second hook members (30).

U.S. Pat. No. 1,879,244 issued 1932 teaches a "scaffold support" wherein there is taught a bracket which frictionally engages a ladder, the bracket having a hook emanating therefrom to engage a structure to support same.

U.S. Pat. No. 5,078,532 issued 1992 teaches a "Scaffold Connection" wherein there is provided a first ring member having an upper side and a lower side fixedly attachable to a vertical scaffold member, and a connector body having a connector body configured to engage the first ring member.

While the above systems may teach various means to removably affix members to a scaffold or other structure, none are believed to contemplate the easily implemented, effective, and safe system of the present invention.

GENERAL SUMMARY DISCUSSION OF THE INVENTION

Unlike the prior art, the preferred embodiment of the present invention contemplates a stabilizer bracket for affixing a ladder to a scaffold in an easily implemented, safe, and cost effective manner.

The present invention contemplates an apparatus configured to form first and second, spaced gripping ends, the first gripping end configured to securely engage the rungs and vertical supports of a standard ladder configuration, the second gripping end configured to engage a horizontal support bar as may be found on a scaffold, or the like.

The apparatus is formed by first and second plates aligned in planar fashion, the plates supported and spaced by spacer bars, the plates having first and second ends, the first end of the plates having formed therein an upper hook member to engage a horizontal bar of the scaffold, the second end of the plates having formed therein a lower hook member configured to engage the horizontal rung of a ladder, the second end further including an upper engagement member to engage the lateral supports of the ladder. First and second pivotal cams are provided at the upper hook member to removably, yet firmly, secure the unit to the scaffold, once installed.

In the present system, a single bracket may be utilized to support the upper area of a ladder to the horizontal support of a scaffold, or two or more brackets may be utilized with a single ladder to provide spaced support of the ladder to the scaffold, along the length of the ladder, thereby engaging multiple horizontal supports on the scaffold.

It is therefore an object of the present invention to provide a ladder support system which is safer, easier to implement, and more stable than prior art systems.

It is another object of the present invention to provide a scaffold ladder support system which may be utilized with most ladders and scaffolds.

It is still another object of the present invention to provide a scaffold ladder support system which may be utilized with one or several support brackets.

Lastly, it is an object of the present invention to provide a scaffold ladder support which is easily removed or repositioned after installation.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 1 is an isometric, side view of the bracket of the present invention, illustrating the first end upper hook configured to engage a horizontal support member, and the second end, lower hook configured to engage the rung of a ladder or the like.

DETAILED DISCUSSION OF THE INVENTION

Figure 1:
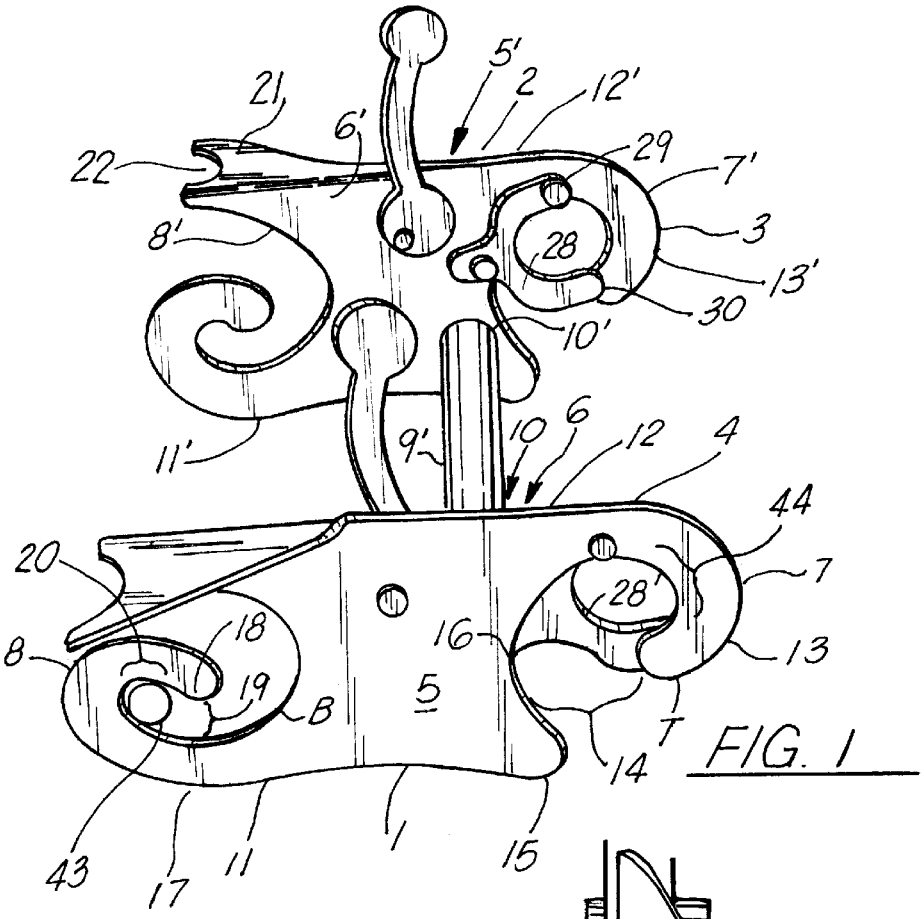
Figure 2:
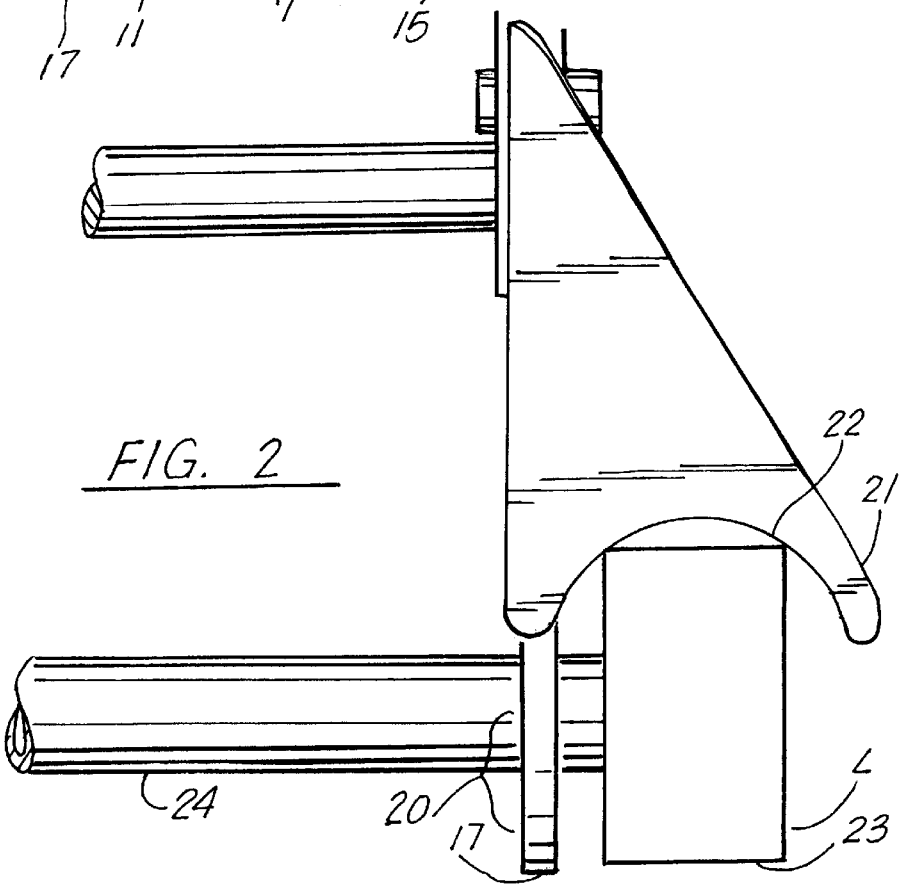
FIG. 2 is a top, partial view of the invention of FIG. 1 with a ladder situated with the bracket such that the rungs of the ladder are in engagement with the second end, lower hook, and a vertical support of the ladder engages lateral engagement member (21).

Referring to FIG. 1, the preferred embodiment of the present invention utilizes a stabilizer bracket 1 comprising a frame 2 including first 3 and second 4 aligned plates, each plate having outer 5, 5' and inner 6, 6' faces, lower 11, 11' and upper 12, 12' portions, and first 7, 7' and second 8, 8' ends respectively, the plates 3, 4 spaced by a spacer bar 9 having first 10 and second 10' ends.

Figure 5:
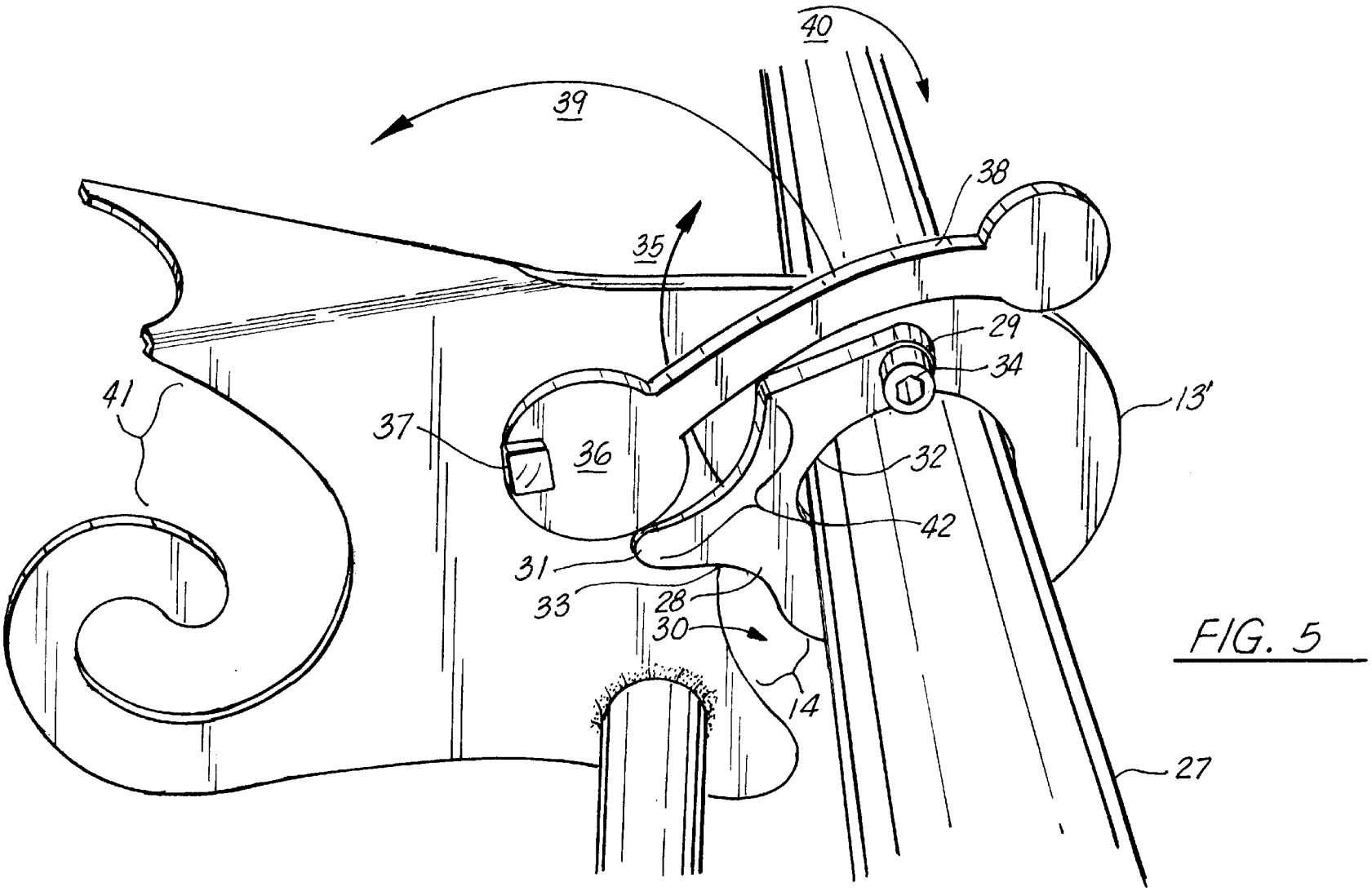
FIG. 5 is a partial, side, isometric view of the invention of FIG. 3, illustrating the operation of the cam lever/horizontal bar engagement to lock the first end, upper hook of the bracket.

As shown, the first end 7, 7' end of the first 3 and second 4 plates have formed therein upper hook members 13, 13', respectively, each said upper hook member configured to engage a horizontal bar of the scaffold, each upper hook member 13, 13' having a hook downwardly directed back towards the lower portion 11, 11' of said aligned plates, forming a radial inner edge 16 beginning with tab 15, such that each hook is generally directed towards the lower portion of its respective plate, with the tip T of each hook turned towards said tab 15, and spaced from same, forming an opening 14 of adequate size to allow the passage of a horizontal support bar 27 to pass therethrough, as shown in FIGS. 1 and 5.

Continuing with FIGS. 1 and 5, situated near the radial inner edge 16 of each upper hook member 13, 13' is a "C" configured engagement member 28, having first 29 and second 30 ends, a radial inner edge 32, an outer edge 33, and a cam engagement tab 31 situated generally medially along the outer edge thereof. The "C" configured engagement member 28 is pivotally affixed 34 at its first 29 end to the plate via threaded connector, welded axle or the like, in the vicinity of each upper hook member 13, 13', in near the radial inner edge 32 thereof, so as to allow the member to swing 35 to unblock passage or opening 14 to allow for the placement or removal of a horizontal support member 27 within first end upper hook 13, 13', and pivot back such that the second end 30 of the "C" configured engagement member blocks opening 14, and the radial inner edge 32 of said "C" configured engagement member engages the horizontal support member, to facilitate locking it in place.

Cam 36, pivotally affixed 37 in off-center fashion to the plate, is configured to engage radial engagement area 42 situated along the outer edge 33 between tab 31 and the first end 29, to lock the unit in an engaging position about the horizontal support member 27, upon application of lever 38 in the direction 40 of the first end upper hook 13, 13', and allow the "C" configured engagement member 28 to be pivoted back into a non-isolating position upon the pulling back 39 of the lever, allowing the second end 30 of the "C" configured engagement member pivot back, thereby un-blocking opening 14.

Figure 3:
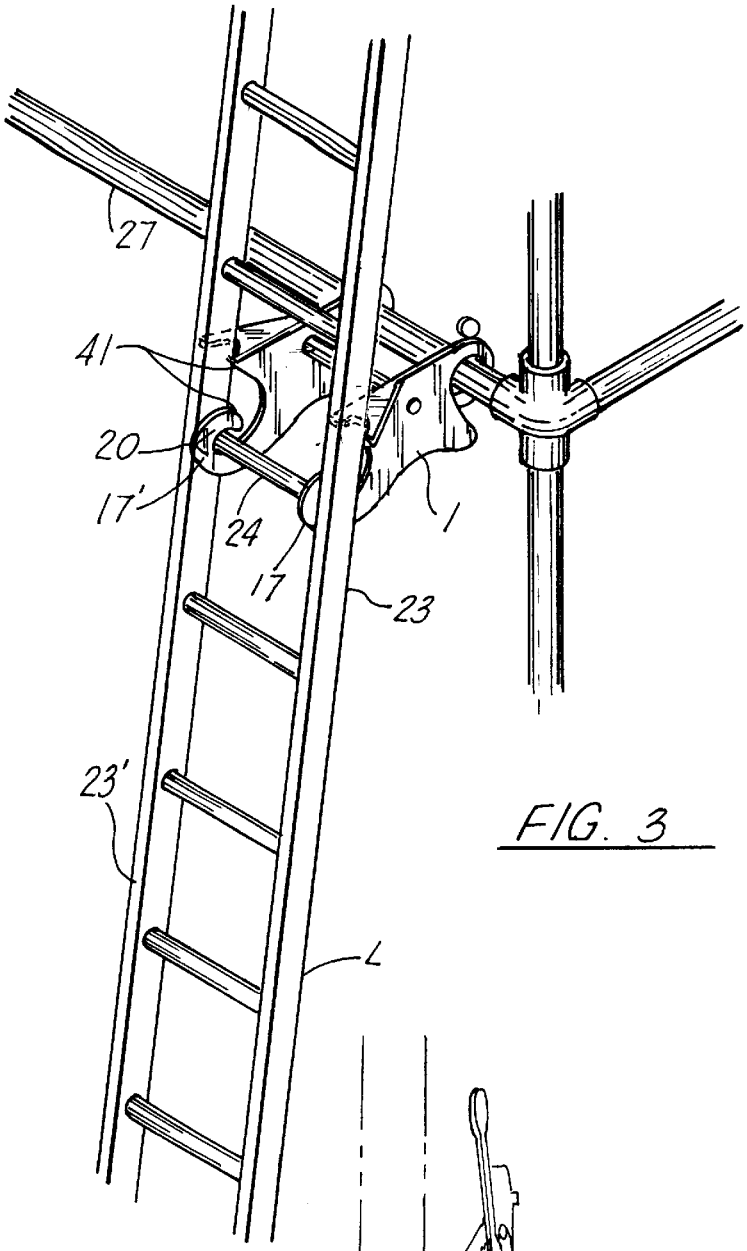
FIG. 3 is an isometric view of the system of the invention of FIG. 1, illustrating the bracket in use firmly supporting a ladder in relation to a scaffold.
Figure 4:
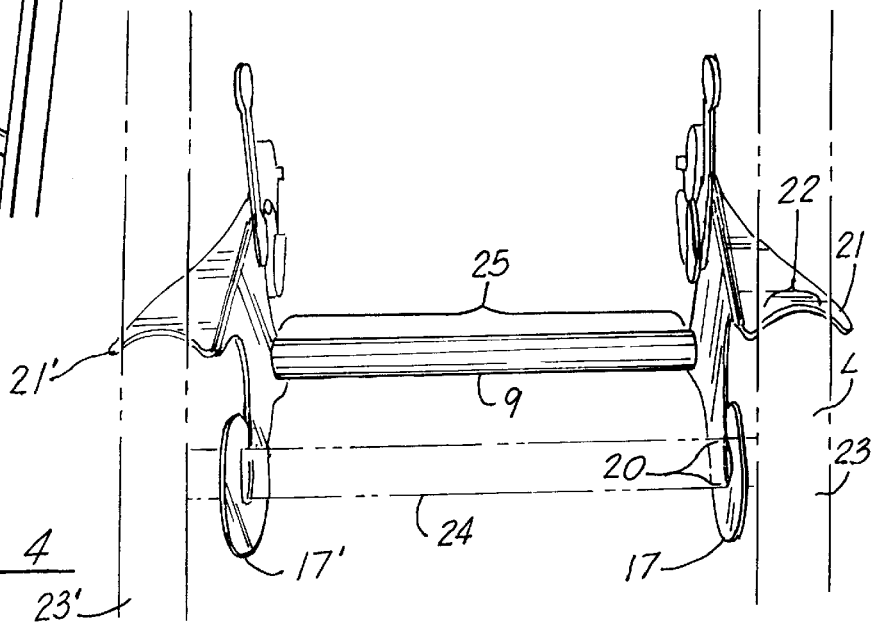
FIG. 4 is a front view of the invention of FIG. 2, illustrating the rungs of a ladder (in phantom) engaged to the second end, lower hook of bracket, and the vertical support of ladder engaging lateral engagement member (21) of bracket.

Continuing with FIG. 1, the second end 8, 8', lower portion 11, 11' of plates 3, 4, respectively, each have formed therein a lower hook member 17 comprising a hook generally directed towards the upper portion of its respective plate, each hook having a tip 18 which is generally directed towards said upper portion of said plate, and back toward its base B, forming an open space 19 for passage of a ladder rung there through, as well as a rung engagement area 43 along its inside edge 20 configured to engage the horizontal rung 24 of a ladder, the upper portion 12, 12' of each plate further including a lateral engagement member 21 comprising a generally radial outer edge 22 situated in spaced relationship along a lateral plane above the supporting inside edge 20 formed in lower hook member 17, the position of the lateral engagement member 21 and radial outer edge 22 is configured to engage a respective vertical support 23 of the ladder, which, in combination with lower hook member 17, acts to lock the ladder in place, once installed, as shown in FIGS. 3 and 4. Further note, that the length 25 of the support bar 9 is less than the length 26 of the rung 24 of the ladder L to which the bracket is engaged, so that the lower hook members 17, 17' may each engage the rung 24, while the lateral engagement members 21, 21' are spaced in a wider fashion to accommodate the first and second ladder L vertical supports 23, 23', respectively.

In use, continuing with FIGS. 3, 4, and 5, the user first determines which rung is closest in vicinity to the horizontal support on the scaffold or other surface which is to be utilized, with the ladder in a generally vertical position adjacent to the scaffold or other support to which it is to be affixed via bracket. The chosen rung 24 is then guided through the open channel 41 of the second end, lower hooks 17, 17, so that the rung engages the inner support edge 20, and the vertical supports 23, 23' of ladder engage the radial outer edges 22 or lateral engagement members 21, 21'.

Next, continuing with FIGS. 1 and 5, with the ladder affixed to the second end 8, 8' of the bracket 1, the upper hook members 13, 13' of bracket 1 are then affixed to the chosen horizontal support 27 of the scaffold or other structure. In accomplishing this, the horizontal support 27 is passed through the open channel 14 (with the "C" configured engagement member 28 pivoted in a non-blocking position), such that the horizontal support engages the inner radial edge 44 of the upper hook members 13, 13', the "C" configured engagement members 28, 28' are then pivoted such that their radial inner edges 32 communicate with the horizontal support member 27, and the cam 36 is then applied via lever 38 against the radial outer edge 42 of the "C" configured engagement members, locking same in place.

A second bracket (or even more) may also be similarly applied to another rung of the ladder to affix same to another horizontal support member, facilitating an even more stable connection, especially for longer ladders.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A stabilizer bracket for affixing, in spaced fashion, a ladder to a horizontal support member, the ladder having a rung having an outer surface forming a width, first and second ends and a length, the ladder having first and second vertical support members affixed to the first and second ends of the rung, respectively, said stabilizer bracket comprising:

a frame having first and second aligned plates separated by a spacer bar, said first and second plates having first and second ends, an inner side, and an outer side, said first end of said plates having formed therein an upper hook member having formed therein an open channel to allow the passage of said horizontal support member therethrough, and a curved engagement area to partially envelope and engage the width of said horizontal support member, said second end of said first and second plates having formed therein a lower hook member having formed therein an open channel to allow the passage of the rung therethrough, and a curved engagement area to partially envelope and engage the rung of the ladder, said second end of said first and second plates having orthogonally emanating therefrom first and second support flanges, respectively, each of said first and second support flanges having formed therein a recess, said recesses adapted to simultaneously engage said first and second vertical support members of said ladder, respectively, forming an engagement and support surface so as to support the ladder in a spaced manner from said horizontal support member, while stabilizing the ladder in a generally vertical position.

2. The stabilizer bracket of claim 1, wherein there is further provided a "C" configured engagement member pivotally connected to said first and second plates, said "C" configured engagement member forming an engagement surface with aid upper hook member to releasably engage said horizontal support member.

3. The stabilizer bracket of claim 2, wherein there is further provided a pivotal cam engaging said "C" configured engagement member so as to releasably lock said "C" configured engagement member in an engagement position.

4. The stabilizer bracket of claim 3, wherein said spacer bar of said frame has a length, and wherein said length of said spacer bar is less than the length of said rung.

5. The method of stabilizing a ladder to a structure having a horizontal support member, the ladder having a rung having first and second ends and a length, the ladder having first and second vertical support members affixed to the first and second ends of the rung, comprising the steps of:

a. providing a bracket having a frame having first and second ends, said first end of said bracket having formed therein an upper hook member having formed therein an open channel to allow the passage of the horizontal support member therethrough, and curved engagement area to partially envelope and engage the horizontal support member, said second end of said bracket having formed therein a lower hook member having formed therein an open channel to allow the passage of the rung therethrough, and a curved engagement area to partially envelope and engage the rung of the ladder, said second end of said bracket having orthogonally emanating therefrom first and second support flanges, respectively, each of said first and second support flanges having formed therein a recess, said recesses adapted to simultaneously engage the first and second vertical support members of said ladder, respectively, so as to form first and second upper engagement members, respectively;

b. determining which rung of the ladder is closest in vicinity to the horizontal support member;

c. engaging said lower hook member to the rung;

d. engaging said upper hook member to the horizontal support member;

e. engaging said first and second upper engagement members to the first and second vertical support members of the ladder;

f. Supporting and stabilizing the ladder adjacent to, but spaced from, the structure.

6. The method of claim 5, wherein there is further provided in step "a" the additional step of providing a "C" configured engagement member pivotally connected to first and second plates, said "C" configured engagement member forming an engagement surface with said upper hook member to releasably engage said horizontal support member upon engagement with said upper hook member, and there is further provided after step "d" the additional step of engaging said horizontal support member with said "C" configured engagement member, upon engagement with said upper hook member.

7. The method of claim 6, wherein there is further provided in step "a" a pivotal cam to engage said "C" configured engagement member so as to lock said "C" configured engagement member in an engagement position with said horizontal support member, and there is further provided after step "d", after having engaged said horizontal support member with said "C" configured engagement member, the additional step of pivoting said cam to lock said "C" configured engagement member in an engagement position with said horizontal support member.

8. The method of claim 7, wherein there is further included, after the step of pivoting said cam to lock said "C" configured engagement member in an engagement position with said horizontal support member, and further providing the step of providing a second bracket as set forth in step "a" to further stabilize the ladder, and installing said second bracket by, repeating steps b–d.

* * * * *